US008782930B2

(12) United States Patent
Thomas

(10) Patent No.: US 8,782,930 B2
(45) Date of Patent: Jul. 22, 2014

(54) CURBSTONE DEFLECTOR FOR A SNOWPLOW

(75) Inventor: Juergen Thomas, Dortmund (DE)

(73) Assignee: Kueper GmbH & Co. KG, Bochum (DE)

( * ) Notice: Subject to any disclaimer, the term of this patent is extended or adjusted under 35 U.S.C. 154(b) by 0 days.

(21) Appl. No.: 13/505,559

(22) PCT Filed: Oct. 19, 2010

(86) PCT No.: PCT/EP2010/006375
§ 371 (c)(1),
(2), (4) Date: Jul. 17, 2012

(87) PCT Pub. No.: WO2011/054444
PCT Pub. Date: May 12, 2011

(65) Prior Publication Data

US 2012/0279094 A1 Nov. 8, 2012

(30) Foreign Application Priority Data

Nov. 3, 2009 (DE) ..... 10 2009 051 750

(51) Int. Cl.
*E01H 5/06* (2006.01)

(52) U.S. Cl.
USPC ..... 37/270; 37/266

(58) Field of Classification Search
USPC ..... 37/266, 404, 407
See application file for complete search history.

(56) References Cited

U.S. PATENT DOCUMENTS

| | | | | | |
|---|---|---|---|---|---|
| 2,285,039 | A * | 6/1942 | Frank | 37/446 |
| 2,772,490 | A * | 12/1956 | Hnastchcnko | 37/284 |
| 2,983,058 | A * | 5/1961 | Hertz | 37/272 |
| 3,888,027 | A * | 6/1975 | Toews | 37/460 |
| 4,073,076 | A * | 2/1978 | Fortune | 37/266 |
| 4,715,450 | A * | 12/1987 | Hallissy et al. | 172/701.3 |
| 4,833,801 | A * | 5/1989 | Winter | 37/270 |
| 4,899,472 | A * | 2/1990 | Winter | 37/270 |
| 5,224,555 | A * | 7/1993 | Bain et al. | 172/772.5 |
| 5,636,458 | A * | 6/1997 | Drake | 37/270 |
| 5,775,012 | A * | 7/1998 | Hockensmith | 37/270 |
| 6,240,662 | B1 * | 6/2001 | Borowiak | 37/404 |
| 2008/0263907 | A1 * | 10/2008 | Winter | 37/270 |

FOREIGN PATENT DOCUMENTS

| | | |
|---|---|---|
| DE | 33 16 270 | 3/1984 |
| DE | 4424917 A1 * | 1/1996 |
| DE | 297 04 896 | 5/1997 |
| EP | 0 866 173 | 9/1998 |

OTHER PUBLICATIONS

International Search Report of PCT/EP2010/006375, Mar. 3, 2011.

* cited by examiner

*Primary Examiner* — Thomas B Will
*Assistant Examiner* — Joan D Misa
(74) *Attorney, Agent, or Firm* — Collard & Roe, P.C.

(57) ABSTRACT

A clearing strip (1) for the clearing blade of a snowplow, which strip is provided at the top with a steel fastening neck for fastening to the clearing blade, wherein a curbstone deflector (2) is arranged at least on a lateral edge of the clearing strip (1), wherein the lateral edge of the clearing strip (1) can be inserted into a recess in the curbstone deflector (2).

3 Claims, 2 Drawing Sheets

CURBSTONE DEFLECTOR FOR A SNOWPLOW

CROSS REFERENCE TO RELATED APPLICATIONS

Figure 1:
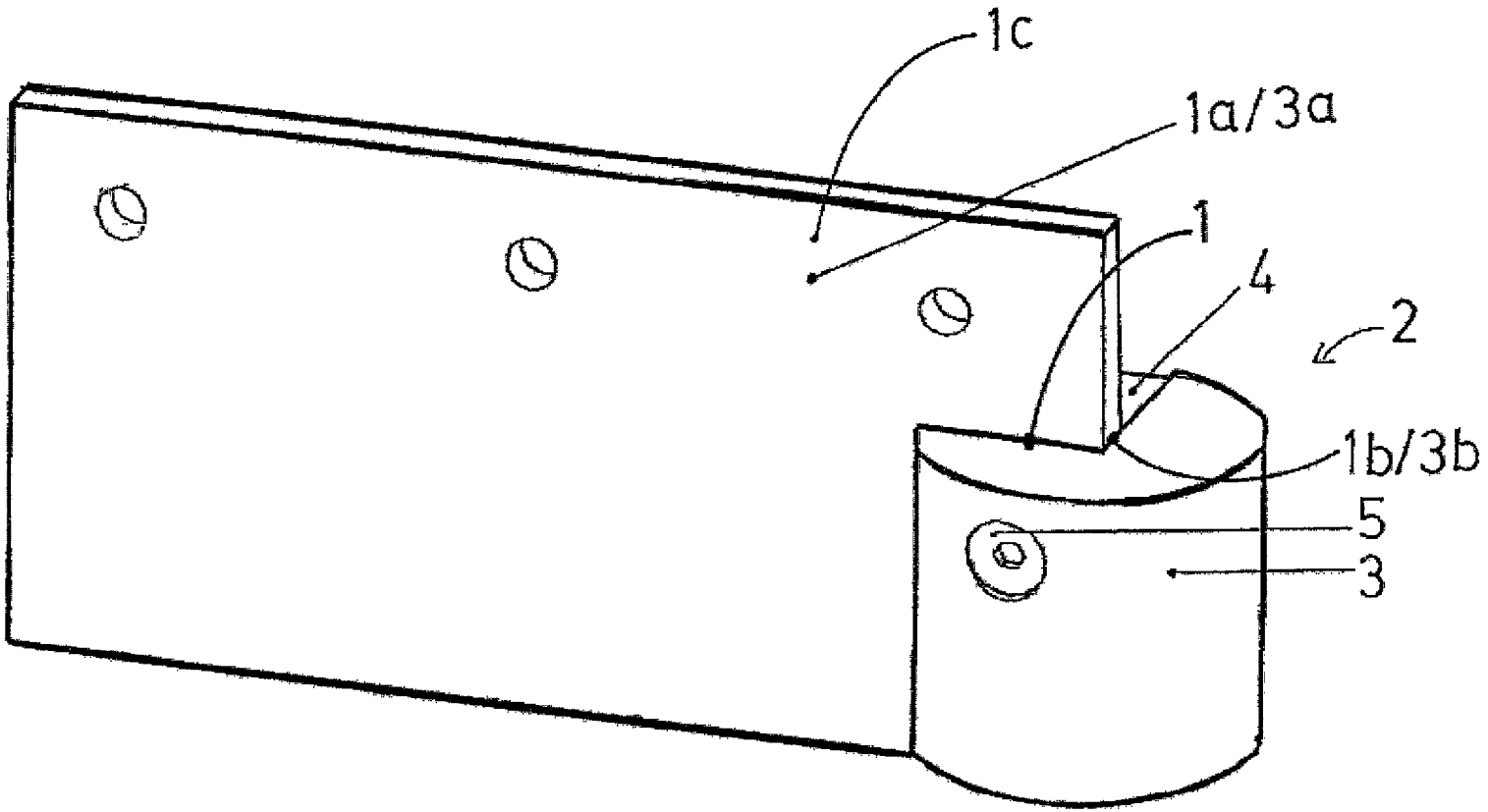

This application is the National Stage of PCT/EP2010/006375 filed on Oct. 19, 2010, which claims priority under 35 U.S.C. §119 of German Application No. 10 2009 051 750.2 filed on Nov, 3, 2009, the disclosure of which is incorporated by reference. The international application under PCT article 21(2) was not published in English.

The invention relates to a clearing strip for the clearing blade of a snowplow, which is provided, at the top, with a steel attachment neck for attachment to the clearing blade.

Clearing strips of this type are known in the state of the art, in different embodiments.

A problem in using these clearing strips consists in that the lateral end region of the clearing strip, i.e. the region that clears the edge of the road of ice and snow, wears laterally. Particularly when the clearing strip impacts obstacles, such as curbs, for example, it is damaged and thereby reduced in its clearing width.

To avoid such damage, the plowshare is already equipped with separate edge deflectors.

However, because the working height of the plowshare lies higher than that of the clearing strip, and the curbstone deflector of the plowshare generally does not project downward beyond the plowshare, collisions with the curb cannot be prevented by these curbstone deflectors if the curb is lower than the clearing strip.

In the state of the art, there are furthermore also solutions that provide for curbstone deflectors on the clearing strip of a snowplow. In the document DE 33 16 270 A1, a curbstone deflector is disclosed, which is mounted, in each instance, so as to rotate about an axis that lies perpendicular to the surface to be cleared. In the event of contact with an obstacle, the impact energy is converted to a rolling movement of the curbstone deflector.

Difficulties arise, in the case of this solution, as the result of a shaft that carries the rotating curbstone deflector and is held by clamping screws. The clamping screws that lie on the outside lie in the engagement region of the snow to be cleared, and can therefore loosen. In the worst case, individual parts of the device can fall onto the road and endanger other road users.

Solutions also exist to avoid these problems, which solutions provide for a one-piece configuration of clearing strip and curbstone deflector. In the utility model DE 297 04 896 U1, a solution is proposed that provides for production of the clearing strip using the casting method. In this connection, the curbstone deflector is cast on, in the form of a block, when the clearing strip is cast.

However, this one-piece configuration of clearing strip and curbstone deflector prevents separate replacement of clearing strip or curbstone deflector. As a result, in the event of wear of or damage to one of the two parts, the entire device must be replaced, in each instance, and this causes higher costs than necessary.

It is therefore the task of the invention to create a curbstone deflector for a clearing strip, which deflector can be replaced separately and nevertheless enters into a firm connection with the clearing strip.

To accomplish this task, the invention proposes that a curbstone deflector is disposed at least on one lateral edge of the clearing strip, whereby the lateral edge of the clearing strip can be inserted into a recess of the curbstone deflector. In that the lateral edge of the clearing strip is inserted into the recess of the curbstone deflector, the curbstone deflector is additionally reinforced by the clearing strip situated in it, and a shape-fit connection between clearing strip and curbstone deflector is produced, which has large support surfaces that run transverse to the direction of the forces that act on the curbstone deflector during the clearing work. Therefore it is almost precluded that the curbstone deflector will be torn off from the clearing strip.

It is particularly advantageous, in the sense of the invention, if the curbstone deflector has a polygonal or rounded contour in cross-section, and preferably is configured to be cylindrical. This shaping of the curbstone deflector allows large-area protection of the clearing strip edge in all impact directions. Likewise, no additional edges that could hook onto the obstacle and thereby incur damage are formed.

The invention provides that the curbstone deflector, in cross-section, has two partial circle elements that can be joined together to form a total circle element, in such a manner that the lateral edge of the clearing strip is disposed between the partial circle elements. This two-part configuration of the curbstone deflector improves the shape-fit connection of the clearing strip edge with the partial circle elements of the curbstone deflector.

A particularly advantageous embodiment of the invention provides that the first partial circle element describes an essentially ¾ circle segment in cross-section, and encloses the lateral edge of the clearing strip from the front and from the side, and that the second partial circle element describes an essentially ¼ circle segment in cross-section, and lies against the clearing strip from the back. By means of this embodiment, the partial regions of the curbstone deflector that are subject to the greatest stress are protected by means of a one-piece configuration of the ¾ partial circle element, while the ¼ partial circle element, which can be connected with the ¾ partial circle element with shape fit, serves for stabilization and attachment of the entire curbstone deflector. In addition, displacement of the individual parts relative to one another is prevented by means of the shape-fit connection of the clearing strip and the partial circle elements.

It is practical if the curbstone deflector can be screwed onto the clearing strip, whereby a screwed connection can be passed through the clearing strip and the curbstone deflector in such a manner that a screw head can be countersunk into the curbstone deflector in the direction of travel of the snowplow, and a nut can be screwed in behind the clearing blade and the curbstone deflector, in the direction opposite the direction of travel. Because the screw head is countersunk into the curbstone deflector, the engagement surface between snow and screw head is minimized, so that loosening of the screwed connection is prevented. Because the related nut is screwed onto the screw in the opposite direction, i.e. opposite the direction of travel of the snowplow, behind the clearing blade, the nut does not come into contact with the snow. Therefore loosening of the screwed connection and thus dropping of the curbstone deflector from the clearing strip can be prevented.

It is practical if the curbstone deflector consists essentially of a steel body with which a plurality of hard metal pieces is connected with material fit, particularly soldered. A curbstone deflector configured in this manner is very resistant to abrasive wear, because of the hard metal pieces that are bonded onto it. In particular, tungsten carbide is recommended as a hard metal; it has already been used for similar tasks. Likewise, the curbstone deflector can consist of a wear-resistant, hardened steel or hard casting. In this connection, hard casting refers to a meta-stable cast iron having a high carbide proportion.

Figure 2:
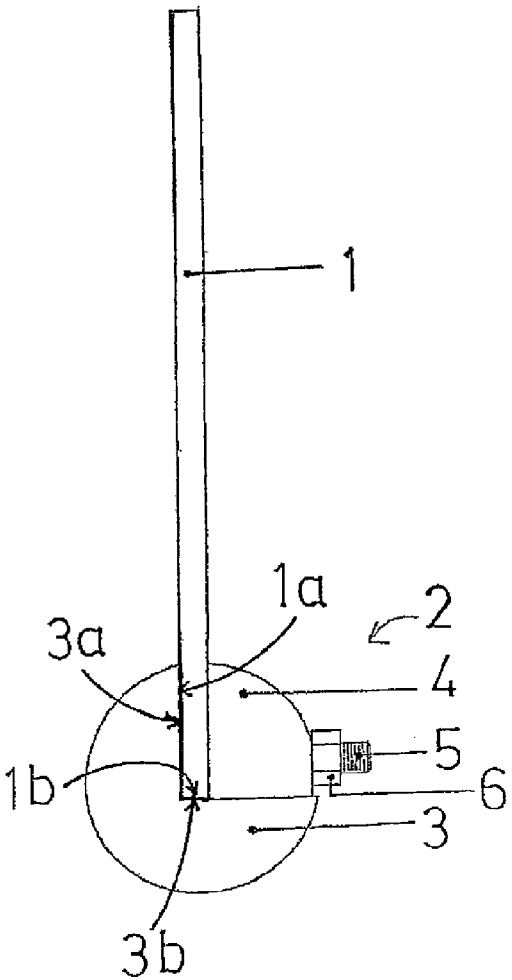

An exemplary embodiment of the invention will be explained in greater detail below, using the drawings. These show:

FIG. 1: A 3D view of the clearing strip with curbstone deflector;

FIG. 2: a top view of the clearing strip with curbstone deflector.

In the figures, a clearing strip 1 having a curbstone deflector 2 and having at its top a steel attachment neck 1*c* according to the invention is shown. The curbstone deflector 2 consists of a ¾ partial circle element 3 and a ¼ partial circle element 4, between which the clearing strip 1 is disposed. The partial circle elements 3, 4 and the clearing strip 1 are screwed to one another by means of a screw 5 and a nut 6 affixed to the latter.

The invention functions in such a manner that the two partial circle elements 3, 4 are screwed onto the clearing strip 1 in such a manner that a shape-fit arrangement is formed at support faces 1*a*, 1*b* of the clearing strip 1 and at support faces 3*a*, 3*b* of the curbstone deflector 2. In this connection, the ¾ partial circle element 3 is placed around the lateral edge of the clearing strip 1 from the front and from the side, and the ¼ partial circle element 4 is laid against the clearing strip 1 from the back, counter to the direction of travel of the snowplow. A screw 5 is now pushed through the ¾ partial circle element 3, the clearing strip 1, and the ¼ partial circle element 4, in such a manner that the screw head 5 is countersunk in the ¾ partial circle element 3 of the curbstone deflector 2. On the back of the clearing strip 1, a nut 6 is screwed onto the screw 5 in such a manner that the ¼ partial circle element 4 of the curbstone deflector 2 lies firmly against the clearing strip 1.

The curbstone deflector 2 includes a plurality of hard metal pieces connected with material fit. A curbstone deflector 2 configured in this manner is very resistant to abrasive wear, because of the hard metal pieces that are bonded onto it. The hard metal pieces may be formed from tungsten carbide.

During use of the clearing strip 1 with curbstone deflector 2, according to the invention, the clearing edge of the clearing strip 1 is protected from impact on curbs, for example, by the curbstone deflector 2. When an impact occurs, the obstacle comes into contact only with the ¾ partial circle element 3 of the curbstone deflector 2. The displaced snow also engages primarily on the ¾ partial circle element 3, so that the nut 6, which is situated behind the clearing strip 1, cannot be loosened.

The invention claimed is:

1. A clearing strip for a clearing blade of a snowplow comprising:

(a) a top;

(b) a steel attachment neck provided at the top for attachment to the clearing blade;

(c) at least one lateral edge;

(d) a curbstone deflector disposed on said at least one lateral edge;

wherein said curbstone reflector has a polygonal or rounded contour in cross-section;

comprises a wear-resistant hardened steel or hard casting; and has a recess embracing said at least one lateral edge from the front and from the side so as to establish a shape-fit connection between said at least one lateral edge and said curbstone deflector;

wherein said shape-fit connection is formed at support faces of said clearing strip and at support faces of said curbstone deflector, said support faces of said clearing strip and of said curbstone deflector running transverse to a direction of forces acting on said curbstone deflector during clearing work; and wherein the curbstone deflector is secured onto the clearing strip with at least one screw passing through the clearing strip and the curbstone deflector in such a manner that a screw head of the at least one screw is countersunk into the curbstone deflector in a first direction of travel of the snowplow, and a nut is screwed on the at least one screw behind the clearing blade, in a second direction opposite the first direction of travel.

2. The clearing strip according to claim 1, wherein the curbstone deflector, in cross-section, has first and second partial circle elements that can be joined together to form a total circle element, in such a manner that the at least one lateral edge is disposed between the first and second partial circle elements.

3. The clearing strip according to claim 2, wherein the first partial circle element describes an essentially ¾ circle segment in cross-section, and encloses the at least one lateral edge of the clearing strip from the front and from the side, and wherein the second partial circle element describes an essentially ¼ circle segment in cross-section, and lies against the clearing strip from the back.

* * * * *